US008132341B1

(12) United States Patent
Laramore

(10) Patent No.: US 8,132,341 B1
(45) Date of Patent: Mar. 13, 2012

(54) DETACHABLE HEEL SYSTEM

(76) Inventor: Megan Doreen Laramore, Santa Rosa, CA (US)

( * ) Notice: Subject to any disclaimer, the term of this patent is extended or adjusted under 35 U.S.C. 154(b) by 703 days.

(21) Appl. No.: 12/290,376

(22) Filed: Oct. 29, 2008

(51) Int. Cl.
*A43B 3/24* (2006.01)
*A43B 21/36* (2006.01)

(52) U.S. Cl. ..... 36/100; 36/42; 36/36 C

(58) Field of Classification Search ..... 36/100, 36/105, 15, 34 R, 36 R, 36 A–36 C, 42, 97
See application file for complete search history.

(56) References Cited

U.S. PATENT DOCUMENTS

| | | | | | |
|---|---|---|---|---|---|
| 895,924 | A | | 8/1908 | White | |
| 1,234,508 | A | | 7/1917 | Sztari | |
| 1,268,731 | A | | 6/1918 | Kornstein | |
| 1,339,438 | A | * | 5/1920 | Diuk | 36/42 |
| 1,432,340 | A | | 10/1922 | Juriss | |
| 1,492,303 | A | | 4/1924 | Maloney | |
| 1,588,684 | A | * | 6/1926 | Mayorowitz | 36/36 C |
| 1,604,826 | A | | 10/1926 | Homicek | |
| 1,633,449 | A | * | 6/1927 | Mayorowitz | 36/36 C |
| 1,673,452 | A | | 6/1928 | Hegedus | |
| 1,772,069 | A | | 8/1930 | Collier et al. | |
| 1,825,202 | A | | 9/1931 | Pudin | |
| 1,875,558 | A | | 9/1932 | Brown | |
| 2,288,168 | A | | 6/1942 | Leu | |
| 2,645,864 | A | | 7/1953 | Ballasch | |
| 3,063,168 | A | | 11/1962 | Cortina | |
| 3,063,169 | A | | 11/1962 | Cortina | |
| 3,266,177 | A | * | 8/1966 | Holden | 36/36 C |
| 3,797,136 | A | | 3/1974 | Soleri | |
| 4,670,996 | A | | 6/1987 | Dill | |
| 4,805,320 | A | | 2/1989 | Goldenberg et al. | |
| 5,079,857 | A | | 1/1992 | Clifton | |
| 5,133,138 | A | | 7/1992 | Durcho | |
| 5,456,026 | A | | 10/1995 | Lewis | |
| 5,524,365 | A | | 6/1996 | Goldenberg | |
| 5,953,836 | A | | 9/1999 | Watt et al. | |
| 7,185,448 | B2 | | 3/2007 | Schupbach | |
| 2007/0256330 | A1 | * | 11/2007 | Wallin et al. | 36/102 |
| 2008/0235991 | A1 | | 10/2008 | Visser | |
| 2008/0244931 | A1 | | 10/2008 | Gallegos | |

* cited by examiner

*Primary Examiner* — Jila Mohandesi
*Assistant Examiner* — Melissa Lalli
(74) *Attorney, Agent, or Firm* — Risto A. Rinne, Jr.

(57) ABSTRACT

An apparatus for converting a shoe into a high heeled type of shoe or a medium high heeled type of shoe or a low heeled type of shoe or a type of shoe that does not include an additional heel to extend the thickness of the sole includes a heel that is detachably-attachable with respect to the pair of shoes. A bayonet mount is used to secure a detachable heel to each of the pair of shoes. A mechanical latch that includes a release member prevents accidental release and loosening of the heel. Additional pair of heels that include the bayonet mount are used when a different height, color, or appearance is desired. If desired, the shoes can be used without heels.

5 Claims, 4 Drawing Sheets

DETACHABLE HEEL SYSTEM

BACKGROUND OF THE INVENTION

1. Field of the Invention

The present invention, in general, relates to shoes and, more particularly, to shoes that have a heel attached thereto.

Both men and women often wear shoes with heels attached. When the heel is sufficiently long, the shoe is referred to as a "high heel" shoe or as a "high heeled" shoe. The terms are used interchangeably herein. High heel shoes are typically worn by women, though not exclusively.

There are many style variations of high heel shoes that include a pumps, T-straps, sling-backs, one-bars, and casual styles. Also, certain boot styles may include a high heel or a shorter height type of heel and whenever the term "shoe" is used herein it is intended to also include boots. Numerous other styles of shoes (or boots) other than those mentioned herein may also include a heel and benefit from the instant invention which is adapted for use with heels that range from very low (little height) to those that are very high (a great deal of lift).

Although the instant invention can be used with heeled shoes that are worn by either men or women, the following discussion focuses, in particular, on the needs of women. However, certain of these needs also apply to heeled shoes or boots that are worn by men. Accordingly, the invention is adapted for inclusion (i.e., for use) with heeled shoes that are used by either gender and of any style.

A heel elevates the woman making her appear to be taller than she really is. In our society and in many other societies a taller appearance for a woman is often preferred. Accordingly, it is common to see women in high-heel shoes at dinners, shows, and especially at gala events.

Often, when about the town the attire and finery that is worn will be formal, elegant, or in some other way fashionable. In our society it is common for women to feel especially beautiful and attractive when dressed in "heels" and wearing a flattering dress or a fashionable evening gown. Apparently, many men also share similar views and find that a woman wearing heels, fashionable attire, and finery to be especially attractive.

For these and other reasons, women tend to wear heel shoes and, in particular, high heeled shoes. However, high heeled shoes tend to be uncomfortable to wear, especially for extended periods of time. This is because many high heel shoes tend to crowd the toes and other parts of the feet into a limited space so as to provide an attractive contour to the shoe. This can cause chafing, irritation, and even blisters to form.

Additionally, the height of the heel changes the way that the load (i.e., the weight of the body) is distributed to the foot causing the ball of the foot to bear an increasing and disproportionate amount of the total weight of the body. The higher the heel the more exaggerated this effect becomes. This can result in a tiring of certain of the muscles causing weariness and fatigue. Stretching of ligaments and tendons may also occur. After protracted wearing of high heeled shoes may women experience some form of foot, ankle, or leg pain and discomfort.

Even so, many women are willing to wear high heel shoes for extended periods of time and to endure the weariness and discomfort including the risk of acute pain in order to look and feel especially beautiful.

Sometimes, women will wear more comfortable shoes while in transit to an event or social gathering and change into the more attractive heeled or high heeled shoes immediately prior to the event or gathering. At the conclusion of the event or gathering they will quickly slip out of the heeled shoes and back into the more comfortable shoes for the return trip home.

It is a shared experience among many women that, because of the discomfort and pain that comes from wearing heeled shoes for extended periods of time, they can hardly wait to shed the more attractive heeled shoes in favor of donning a more comfortable pair of shoes at the earliest possible opportunity.

However, often the woman is unable to bring another pair of shoes along with her. If she is being escorted either by automobile, public transit, or by walking it is not practical for her to wear a second, more comfortable pair of shoes, while storing the larger heeled shoes in perhaps, a tiny fashionable purse.

Also, while she is being escorted, the woman is likely to want to present her most attractive appearance and that would generally include her wearing high heeled shoes. In situations where the transport of a second pair of shoes is neither possible nor practical or if she is being escorted, a woman is apt to wear the less comfortable high heeled shoes.

It generally matters little how uncomfortable high heeled shoes may be to wear for extended periods of time when the woman believes that she, in order to appear most attractive, must continue to wear the heeled shoes. Consequently, she is apt to wear high heeled shoes and endure discomfort until she again arrives at home and is able to remove the high heeled shoes and don a more comfortable pair of shoes.

Accordingly, there is a need for a heeled shoe that can be worn with the heel, regardless of its height, during events and social gatherings but which can be readily converted into a more comfortable, but still highly fashionable shoe. Similarly, there is a need for a heeled shoe that can be worn during transit to and from an event or other type of social gathering.

Another problem women face concerns the height of the heel. This is influenced by the dress or gown or other attire that the woman is wearing. Certain garments look and fit generally better when worn with shoes that have an especially high heel. Other garments look and fit generally better when worn with shoes that have a mid-height heel. Still, other garments look and fit generally better when worn with shoes that have an especially low heel or no heel at all.

The style and color of a particular pair of shoes may go especially well with a particular dress or gown that is to be worn or with the total outfit that is to be worn. The woman may very much desire to wear that pair of shoes with the dress or gown only to discover that the height of the heel is not acceptable for the outfit that is being worn. This, therefore, prohibits the wearing of that particular pair of shoes with that particular outfit. The woman may feel loss or sadness in not being able to wear the pair of shoes that she would prefer because the height of the heel is incorrect.

Accordingly, there is a need for a heeled shoe that can be readily adapted for use with heels of different height, thereby permitting a wearer to change the height of the heel to optimize the appearance of the shoes with any given attire that is to be worn.

A further difficulty that women encounter is matching the color of their shoes with that of the outfit that is being worn. It is generally desirable to match the shoe color or to match an accent color that may be included on the shoes with a similar color that appears on some part of the outfit (attire) that is being worn. Exactly what is being matched and how much of a color match (in area) is required in order to create the desired appearance is a variable that depends on many factors. Generally, the woman will decide what "works" for any given ensemble that is being worn. However, at least some color matching is usually required to tie various articles of clothing or finery together.

Often the amount or total area of color matching that needs to take place is minimal in order for the shoes to "tie into" the ensemble. For example, if an accent color on a pair of shoes is small in area but matches with the color of any garment that is being worn or with any accent piece that the woman is wearing, such as a hat, scarf, designer label, article of jewelry, or other finery the resulting small color coordination may be sufficient to connect the shoes with the overall outfit and create an appearance and perhaps a striking appearance that is desired.

Alternately, there may be times when a woman will want to have an accent color on her shoes match with the primary color of a garment and not with an accent color that may appear on the garment. The entire garment may be of the primary color and not include any accent color. The woman may desire that an accent color in the shoes match the primary color of the garment in order to tie both articles together, and thereby legitimize the appearance of the shoes or the garment.

Even if the overall appearance of the heeled shoes is acceptable and even if height of the heels is ideal for the outfit that is being worn, the heeled shoes may still not coordinate with any part of the outfit (ensemble) that is being worn. When the shoes do not properly coordinate they are said to "not go" with the outfit and it is likely that the shoes will not be worn with the outfit. If shoes that do not coordinate are worn (for whatever reason) then there is risk that the overall appearance of the outfit will be less than ideal.

Accordingly, there is a need for a heeled shoe that can be adapted to color-coordinate with at least some article of an overall ensemble or outfit.

Accordingly, a woman has a need to be able to change either the height of the heel or its color, or both in order to coordinate the appearance of the shoes with an outfit. Additionally, there is a need that this be accomplished quickly and easily.

Furthermore, there is a need to be able to secure a heel in place on the shoe and not have it become loose or dislodge unintentionally. If the heel were to loosen or dislodge at random and without the conscious intent and action by the wearer there is a possibility that the wearer could trip or fall and experience personal injury.

Accordingly, there exists today a need for a detachable heel system that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and are not specifically mentioned herein.

Clearly, such an apparatus (or system) would be useful and desirable.

2. Description of Prior Art

High heel shoes are, in general, known. The heels are attached in ways that are intended to permanently affix each heel to each of the shoes. While the structural arrangements of the known prior art types of devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a detachable heel system that includes a heel that is detachably-attachable with respect to a shoe.

It is also an important object of the invention to provide a detachable heel system that includes heel with a bayonet connector for attachment to or removal from a shoe.

Another object of the invention is to provide a detachable heel system that permits a user to interchange heels.

Still another object of the invention is to provide a detachable heel system that permits a user to interchange heels to vary the height of the heels, as desired.

Still yet another object of the invention is to provide a detachable heel system that permits a user to interchange heels to vary the color of the heels, as desired.

Yet another important object of the invention is to provide a detachable heel system that permits a user to interchange heels to vary the appearance of the heels, as desired.

Still yet another important object of the invention is to provide a detachable heel system that permits a user to remove the heels of a shoe, as desired.

A first continuing object of the invention is to provide a detachable heel system that increases the versatility of a pair of shoes by permitting a user to vary the appearance of a pair of heeled shoes to better coordinate with an outfit that the user is wearing.

A second continuing object of the invention is to provide a detachable heel system that resists inadvertent loosening or separation from a pair of shoes.

A third continuing object of the invention is to provide a detachable heel system that is safe.

A fourth continuing object of the invention is to provide a detachable heel system that permits quick and easy interchange of a heel with respect to a shoe.

Briefly, a detachable heel system that is constructed in accordance with the principles of the present invention has a pair of shoes with a heel that is detachably-attachable with respect to the pair of shoes. A first half of a bayonet mount is attached to the sole of each of the shoes and a second half of a bayonet mount is attached to an upper end of each heel of a first pair of heels. Each of the first pair of heels can be attached to or removed from each of the shoes by disengaging a mechanical latch and rotating the heel with respect to the shoe an amount sufficient to detach the heel from the shoe. Additional pair of heels that include the second half of the bayonet mount can be attached to the shoes in lieu of the first pair of heels, as desired. The additional pair of heels can include any of a different height, color, or appearance, as desired. The heels are used in pairs to modify both the right and left shoes of the pair of shoes. Any of the first pair of heels or any of the additional pair of heels can be used with additional pairs of shoes providing the additional pairs of shoes include the first half of the bayonet mount, thereby further increasing versatility. If desired, the first pair of heels can be removed from the first pair of shoes and the shoes used without heels, thereby converting the first pair of shoes into a modified first pair of shoes that does not include heels.

DETAILED DESCRIPTION OF THE INVENTION

Figure 1:
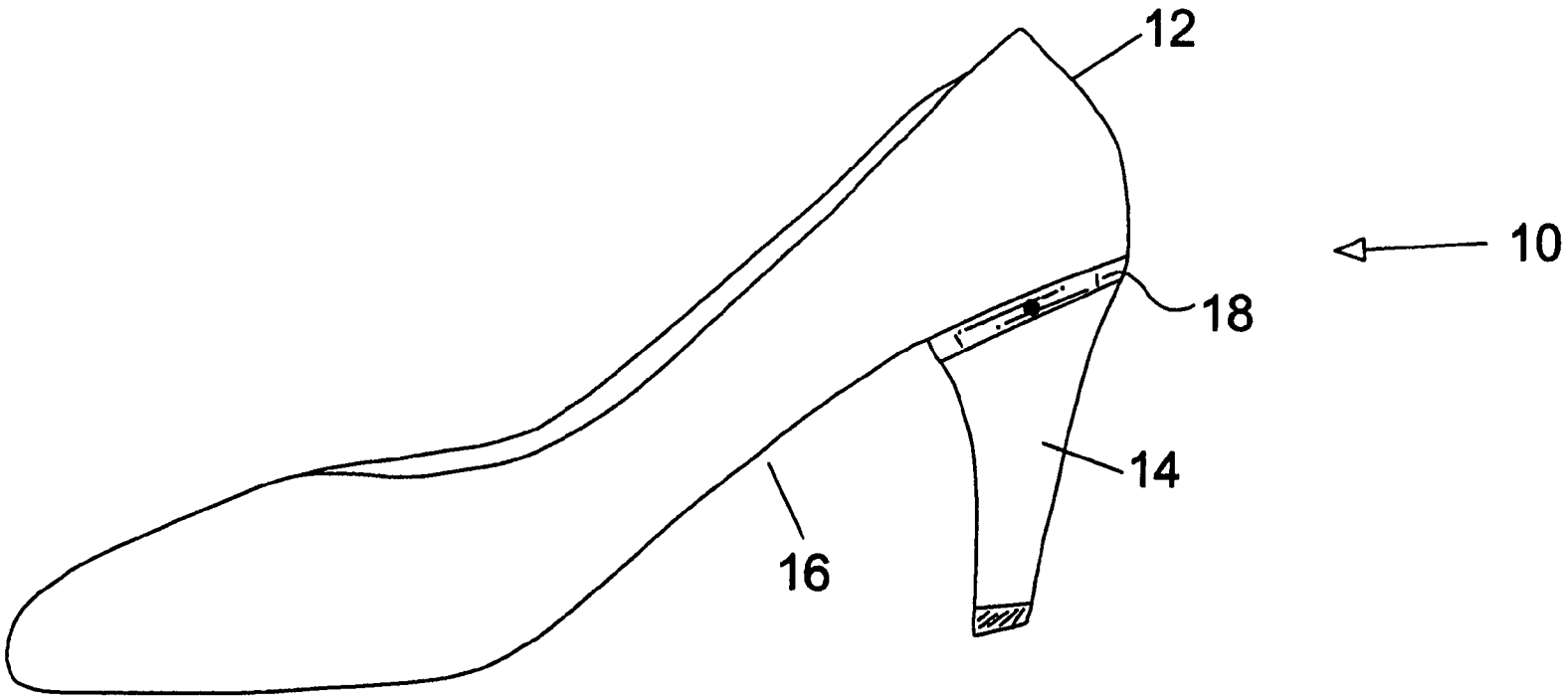
FIG. 1 is a view in perspective of detachable heel system for use with a high heel shoe and with a detachable heel attached thereto.

Referring to FIG. 1 and on occasion to all of the drawing figures is shown, a detachable heel system, identified in general by the reference numeral 10. The detachable heel system 10 is attached to a shoe 12.

The detachable heel 10 system includes a first heel 14 that is detachably-attachable with respect to the shoe 12. Because the first heel 14 is a type of "high heel", when it is attached to the shoe 12 the shoe 12 becomes (i.e., is converted into) a high heel type of the shoe 12.

The shoe 12 is converted into a "high heel" type of shoe because the first heel 14 is sufficiently high (i.e., because it has a sufficiently long longitudinal length) to elevate a rear portion of a sole 16 of the shoe 12 an amount that is typical for a high heel type of the shoe 12. However, and as is described in greater detail hereinafter, use of the detachable heel system 10 can change the shoe 12 into a type of the shoe 12 having a medium (or any desired) height for its heel, or if preferred, into a type of the shoe 12 that has no heel at all attached to it.

It is, of course, to be understood that the detachable heel system 10 includes a second shoe to form a pair of shoes (only one of the shoes 12 is shown). If the shoe 12 is for a wearer's right foot then the second shoe would be for the wearer's left foot, or vice-versa. The description herein for the detachable heel system 10 and for the shoe 12 also appertains to and is repeated for the second shoe.

Figure 2:
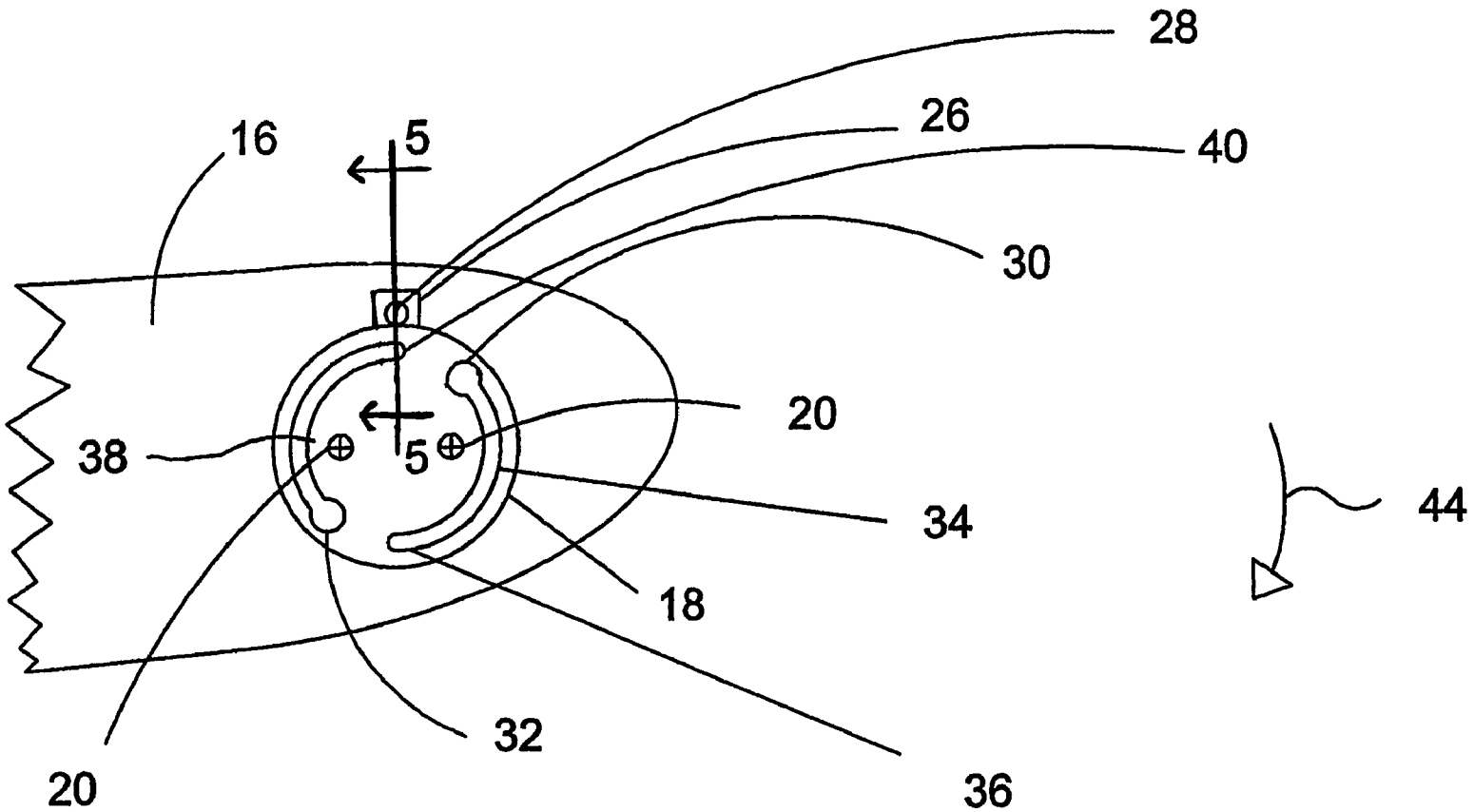
FIG. 2 is a bottom view of a rear portion of the high heel shoe of FIG. 1 with the detachable heel removed therefrom.

The shoe 12 includes a first half of a bayonet mount 18 (see also FIG. 2) that is attached to the sole 16 of the shoe 12 by screws 20 or any preferred means, including the use of an adhesive or by molding the first half of a bayonet mount 18 into the sole 16. The first half of a bayonet mount 18 is securely attached to the shoe 12.

The first heel 14 includes a second half of a bayonet mount, identified in general by the reference numeral 21 (see also FIG. 3 and FIG. 4) that is attached to an upper end of the first heel 14. The second half of a bayonet mount 21 includes a pair of T-shaped screws 22 that are embedded in an upper planar surface 22*a* of the first heel 14 and which are securely attached to the first heel 14. If desired, the T-shaped screws 22 include screw threads 23 that are similar to the threads of a wood screw (not shown). Alternately, the T-shaped screws 22 can be attached to the first heel 14 by molding or by any other preferred method. The T-shaped screws 22 are made from metal or any other sufficiently strong material.

Figure 5:
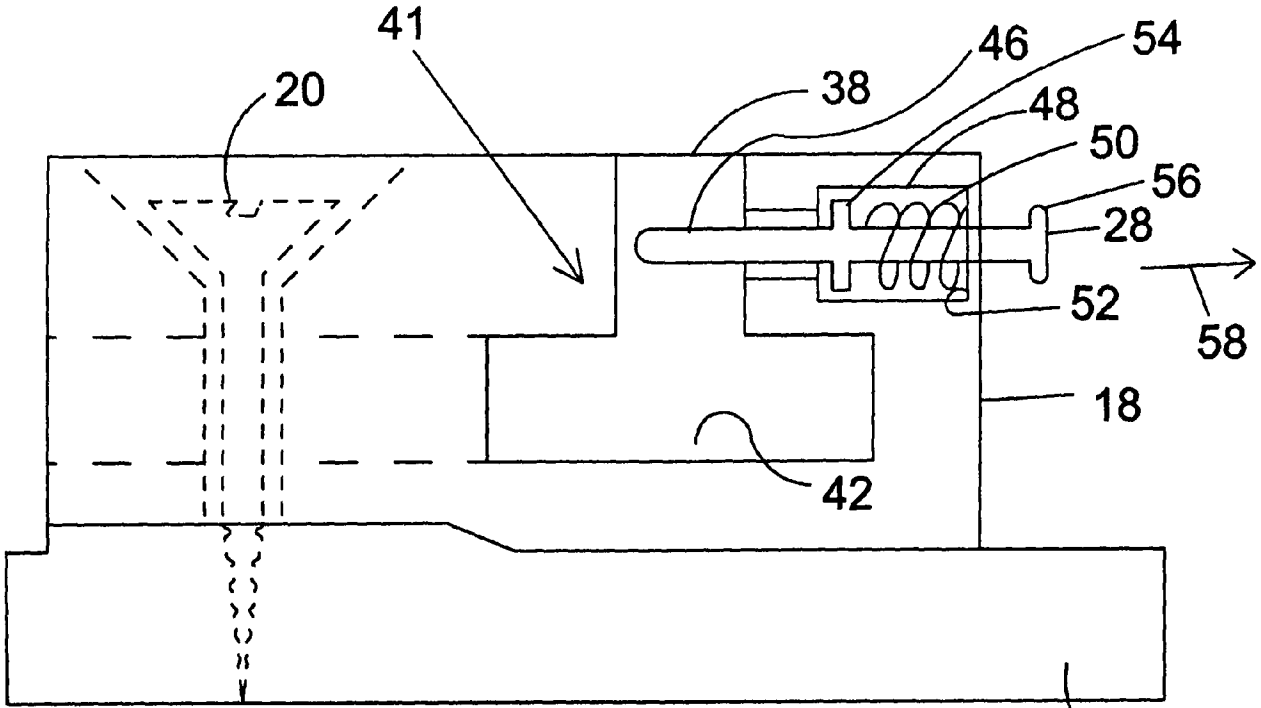
FIG. 5 is a cross sectional view taken on the line 5-5 in FIG. 2.

If desired, a wear surface 24 is included at a lower end of the first heel 14. The first half of a bayonet mount 18 can be attached so that it is disposed on top of the sole 16. This is illustrated in FIG. 5.

Alternately, as desired, the first half of a bayonet mount 18 can be attached so that it is embedded in the sole 16. This configuration is illustrated by FIG. 1 and by FIG. 2. If the bayonet mount 18 is embedded in the sole 16, a cutout area 26 is provided in the sole 16 to allow a wearer (not shown) of the high heel shoe 12 to access a release member 28. The release member 28 is discussed in greater detail hereinafter.

In this manner, the entire first half of a bayonet mount 18 is disposed within the sole 16 so that no portion of the first half of a bayonet mount 18 extends beyond the plane of the sole 16. This is useful when the first heel 14 has been removed and the shoe 12 is used without any heel attached thereto. Removal of the first heel 14 is described in greater detail hereinafter.

However, is it important to note that when the first heel 14 is removed the wearer may desire relief from the discomfort caused by protracted usage of the very high first heel 14 with the shoe 12. After the first heel 14 has been removed, if desired, the wearer can continue to walk in the shoe 12 (i.e., in the pair of shoes, after removing the first heel 14 from each of the shoe 12).

In this way, the shoe 12 is converted from a high heel type of the shoe 12 (when the first heel 14 is attached) into a non-heeled type of the shoe 12 that does not include any additional heel other than that which is provided by the thickness of the sole 16. Removal of the first heel 14 from the shoe 12 immediately provides great relief and comfort to the wearer. Also, transport of a bulky second pair of shoes (not shown) is not required by the wearer. The wearer need only find a small place, such as in a purse (not shown) to store the first heel 14 of the shoe 12 (and to store a duplicate of the first heel 14 that is used with the second shoe, not shown).

Because no portion of the first half of a bayonet mount 18 extends beyond the plane of the sole 16, only the exposed surface of the sole 16 contacts the surface of the ground when the wearer continues to use the shoe 12 after having removed the first heel 14. This also helps to make walking more comfortable because of the energy dampening that is provided by the sole 16 contacting the ground surface as opposed to the first half of a bayonet mount 18 contacting the ground surface if it were to protrude. It is also quieter for the sole 16 to make contact with the ground surface than for the first half of a bayonet mount 18 to contact the ground surface.

The first half of a bayonet mount 18 is planar and preferably made of metal or a sufficiently strong plastic or composite material.

To attach the first heel 14 to the shoe 12, the upper planar surface 22*a* of the first heel 14 is urged toward the first half of a bayonet mount 18 and a first of the pair of the T-shaped screws 22 (i.e., the one shown in FIG. 3) is aligned with a corresponding first of a pair of enlarged openings 30 that is provided in the first half of a bayonet mount 18.

Figure 3:
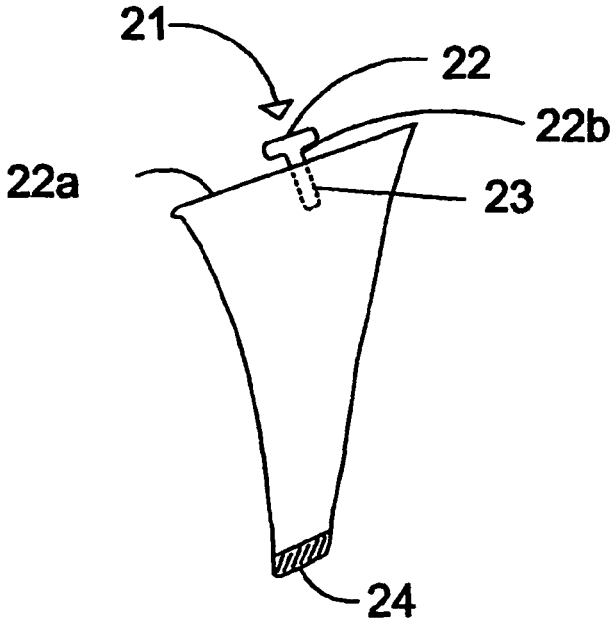
FIG. 3 is a side view of the detachable heel of FIG. 1 that has been removed from the high heel shoe.
Figure 4:
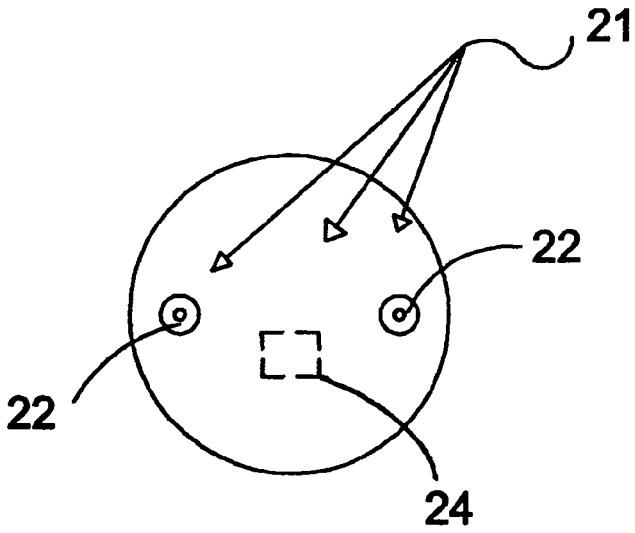
FIG. 4 is a top view as shown in FIG. 3 as seen along the lines 4-4 therein.

A second of the pair of the T-shaped screws 22 (i.e., the one that is disposed behind the T-shaped screw 22 in FIG. 3) is aligned with a corresponding second of a pair of enlarged openings 32 that is provided in the first half of a bayonet mount 18.

The first of a pair of enlarged openings 30 is attached to a first end of a first circular slot 34. The first circular slot 34 extends concentrically around the first half of a bayonet mount 18 for an amount that is less than one-half of the circumference of the first half of a bayonet mount 18. The first circular slot 34 terminates at an opposite second end 36.

The second of a pair of enlarged openings 32 is attached to a first end of a second circular slot 38. The second circular slot 38 extends concentrically around the first half of a bayonet mount 18 for an amount that is less than one-half of the circumference of the first half of a bayonet mount 18 and on an opposite side of the first half of a bayonet mount 18 as compared with the first circular slot 34. The second circular slot 38 terminates at an opposite second end 40.

Referring now in particular to FIG. 5 is shown a cross-sectional view of the second circular slot 38 in which it is observed that the second circular slot 38 includes a cross-sectional shape that includes an upside-down T-shape, identified in general by the reference numeral 41. The upside-down T-shape 41 extends from the second of a pair of enlarged openings 32 to the opposite second end 40 of the second circular slot 38. The first circular slot 34, other than placement on the first half of a bayonet mount 18, is constructed substantially the same as the second circular slot 38, and it therefore also includes the upside-down T-shape 41 that extends from the first of a pair of enlarged openings 30 to the opposite second end 36 of the first circular slot 34.

When the pair of the T-shaped screws 22 are properly aligned with the first and second of a pair of enlarged openings 30, 32 and urged therein, an enlarged head of each of the pair of T-shaped screws 22 is able to pass through the respective first and second of a pair of enlarged openings 30, 32 and for an upper surface of each of the T-shaped screws 22 to reach and make contact with a bottom surface of the first and second circular slots 34, 38. A first bottom surface for the second circular slot 38 is identified by the reference numeral 42, FIG. 5.

The T-shaped screws 22 each include an exposed post portion 22*b* that is disposed above the upper planar surface 22*a* of the first heel 14 and below the enlarged head of each of the T-shaped screws 22. The exposed post portion 22*b* and the enlarged head of each of the T-shaped screws 22 include a T-shape that corresponds with the upside-down T-shape 41 that is provided by the first circular slot 34 and the second circular slot 38. The exposed post portion 22*b* and the enlarged head of each of the T-shaped screws 22 include an overall size that is slightly smaller than that of the upside-down T-shape 41 that is provided by the first circular slot 34 and the second circular slot 38.

Accordingly, after the pair of T-shaped screws 22 of the first high heel 14 are fully disposed in the respective enlarged openings 30 and 32, the first heel 14 is grasped and rotated in a direction as shown by arrow 44 (FIG. 2) as far as it can go until the enlarged head of the T-shaped screw 22 that is disposed in the second circular slot 38 makes contact with a tip 46 of the release member 28.

The release member 28 is disposed in a release area 48 that is provided in the first half of a bayonet mount 18 a short distance before the opposite second end 40 of the second circular slot 38. Access to the release area 48 is provided by a removable panel, not shown, to facilitate manufacture. The release panel is either secured to the first half of a bayonet mount 18 by fasteners or it snaps in place.

A first end of a coil spring 50 bears against an inside surface 52 in the release area 48 and an opposite end of the spring 50 bears against on enlarged ring 54 of the release member 28 to supply a force that is always tending to urge the tip 46 of the release member 28 into the second circular slot 38.

To continue installation of the first heel 14 an enlarged knob 56 is grasped by the wearer and urged in a direction as shown by arrow 58 an amount sufficient to withdraw the tip 46 of the release member 28 out of the second circular slot 38. The wearer then continues to rotate the first heel 14 in the direction of arrow 44 until the T-shaped screws 22 have each reached the opposite second end 36 of the first circular slot 34 and the opposite second end 40 of the second circular slot 38.

The enlarged knob 56 is released and the tip 46 is urged back into the second circular slot 38 by the spring 50, thereby securing the first heel 14 in position. Accordingly, there is no possibility of the first heel 14 accidentally loosening or falling off of the shoe 12. The tolerances between the outside dimensions of the T-shaped screws 22 and the inside dimensions of the first and second circular slots 34, 38 is kept to a minimum to ensure a snug fit of the first heel 14 to the first half of a bayonet mount 18.

When it is intended to remove the first heel 14, the enlarged knob 56 is again grasped by the wearer and urged in the direction as shown by arrow 58 an amount sufficient to withdraw the tip 46 of the release member 28 out of the second circular slot 38. The wearer then rotates the first heel 14 in a direction opposite to that as shown by arrow 44 until the T-shaped screws 22 have each reached the first of a pair of enlarged openings 30 and the second of a pair of enlarged openings 32, at which time the first heel 14 is urged away from the sole 16 of the shoe 12 and is detached therefrom.

Figure 6:
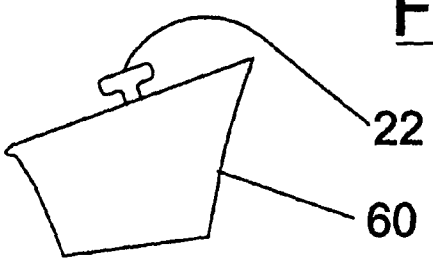
FIG. 6 is a side view of a modified detachable heel for use with the high heel shoe of FIG. 1.

Referring now to FIG. 6 a second heel 60 is shown that includes a lower height than that of the first heel 14. It is to be understood that the first heel 14 and the second heel 60 are available in a variety of colors, patterns, and fabrics. If desired, any preferred accent item (not shown) can also be included with the first heel 14 or with the second heel 60, as desired.

The second heel 60 is attached to and removed from the shoe 12 in a manner identical to that as described for the first heel 14.

Accordingly, the wearer is able to remove the first heel 14 and replace it with a replacement first heel (not shown) having any preferred color, pattern, or fabric to match or better coordinate with an outfit that is being worn. This is done whenever the outfit warrants the use of a high heeled type of the shoe 12.

Accordingly, the wearer is able to remove the first heel 14 and replace it with second heel 60 having any preferred color, pattern, or fabric to match or better coordinate with an outfit that is being worn. This is done whenever the outfit warrants the use of a medium height heeled type of the shoe 12.

It is, of course, to be understood that the use of any desired height of heel can be used with the detachable heel system 10 to provide any desired degree of lift for the shoe 12 as is desired. The second heel 60, for example, can include a low height, if desired.

If desired, the shoe 12 can be worn without any heel attached thereto.

Accordingly, the detachable heel system 10 provides optimum flexibility for the shoe 12 thereby permitting it to be used with the widest possible range of outfits. Furthermore, the detachable heel system 10 allows the wearer to use the shoe 12 with an especially fashionable and very high heel with the first heel 14 and then quickly convert to the lower second heel 60 (or no heel) for improved comfort when the situation warrants doing so. Additionally, the wearer need not carry a bulky second pair of shoes in order to attain these benefits.

In this way, the shoe 12 can be quickly converted from a high heeled type of the shoe 12 into a medium type of the shoe 12 or into a flat (no additional heel) type of the shoe 12, when desired.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

For example, the enlarged heads of the T-shaped screws 22 preferably include a circular shape when viewed from the top, however; a square or other shape is also possible. Similarly, the mechanical latch that is provided by the release member 28 can be modified as desired. If preferred, the release member 28 could be included on the first circular slot 34 instead of on the second circular slot 38 or on both. Also, other types of the mechanical latch can be used other than that as provided by the release member 28.

What is claimed is:

1. A detachable heel system, comprising:

(a) a shoe that includes a sole, (b) a heel that is detachably-attachable with respect to said shoe, and (c) a bayonet mount that includes a first half of said bayonet mount and a second half of said bayonet mount, wherein said first half of said bayonet mount is attached to said shoe; and (d) wherein said second half of said bayonet mount is attached to said heel;

wherein said second half of said bayonet mount is able to cooperate with said first half of said bayonet mount to secure said heel to said shoe and to permit removal of said heel from said shoe;

wherein said first half of said bayonet mount includes a mechanical latch, and wherein said mechanical latch prevents an unintentional release and separation of said heel from said shoe, and wherein said mechanical latch includes a release member that is attached to said first half of said bayonet mount and wherein a force is supplied to said release member by a spring that is sufficient to normally urge a tip of said release member into a slot that is provided in said first half of said bayonet mount, and wherein said second half of said bayonet mount is prevented from rotating an entire length of said slot when said tip of said release member is disposed in said slot, and wherein said release member includes an end that is able to be grasped and urged in a direction away from said slot an amount sufficient to withdraw said tip from said slot when a force sufficient to overcome a force supplied by said spring is applied to said release member, and wherein said end of said release member includes an enlarged end, and wherein said slot includes an enlarged opening at a first end thereof and wherein said slot extends along a radius for a predetermined length along said radius and wherein said slot includes an opposite end, and wherein said slot includes an upside-down T-shape when viewed in cross-section and wherein said upside-down T-shape extends along said length.

2. The detachable heel system of claim 1 wherein said second half of said bayonet mount includes a T-shaped screw attached to an upper planar surface of said heel, and wherein said T-shaped screw includes an enlarged head and an exposed post portion that is disposed above said upper planar surface of said heel and which is attached to an underside of said enlarged head, and wherein said enlarged head and said exposed post are able to cooperate with said upside-down T-shape of said first half of said bayonet mount to secure said heel to said shoe.

3. The detachable heel system of claim 1 wherein said first half of said bayonet mount is attached to said sole of said shoe.

4. The detachable heel system of claim 3 wherein said first half of said bayonet mount is embedded in said sole.

5. The detachable heel system of claim 3 wherein said first half of said bayonet mount is embedded in said sole sufficient so that a lower plane of said first half of said a bayonet mount does not extend below a plane of an exposed surface of said sole of said shoe.

* * * * *